US006421020B1

(12) United States Patent
Chatzipetros et al.

(10) Patent No.: US 6,421,020 B1
(45) **Date of Patent: *Jul. 16, 2002**

(54) VEHICLE ANTENNA ASSEMBLY FOR RECEIVING SATELLITE BROADCAST SIGNALS

(75) Inventors: Argyrios A. Chatzipetros, Lake Worth; Stelios Patsiokas, Plantation; Anh Nguyen, Boynton Beach, all of FL (US)

(73) Assignee: XM Satellite Radio Inc., Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/953,146

(22) Filed: Sep. 17, 2001

Related U.S. Application Data

(63) Continuation of application No. 09/317,947, filed on May 25, 1999, now Pat. No. 6,295,033.

(51) Int. Cl.[7] ..... H01Q 1/32
(52) U.S. Cl. ..... 343/713; 343/895
(58) Field of Search ..... 343/711, 712, 343/713, 715, 878, 895; H01Q 1/32

(56) References Cited

U.S. PATENT DOCUMENTS 4,109,251 A * 8/1978 MacDougall ..... 343/715
4,266,227 A * 5/1981 Blaese ..... 343/715
4,621,243 A * 11/1986 Harada ..... 343/715
4,692,770 A * 9/1987 Kadokura ..... 343/715
4,779,098 A * 10/1988 Blaese ..... 343/715
4,882,592 A * 11/1989 Studer, Jr. et al. ..... 343/715
RE33,743 E * 11/1991 Blaese ..... 343/715
5,099,251 A * 3/1992 Fisher ..... 343/715
5,357,262 A * 10/1994 Blaese ..... 343/702
5,850,199 A * 12/1998 Wan et al. ..... 343/757
5,872,549 A * 2/1999 Huynh et al. ..... 343/895
5,898,407 A * 4/1999 Paulus et al. ..... 343/713
5,898,408 A * 4/1999 Du ..... 343/715

* cited by examiner

*Primary Examiner*—Michael C. Wimer
(74) *Attorney, Agent, or Firm*—Roylance, Abrams, Berdo & Goodman, LLP

(57) ABSTRACT

An apparatus, system and method for providing audio broadcast signals received from a satellite to a satellite radio receiver. A window clip having an integral transmission line is mounted on the edge of a vehicle window. The interior end of the transmission line is connected to the satellite radio receiver. The exterior portion of the clip, and the exterior portion of the integrated transmission line, is coupled to an antenna. The antenna may be an omnidirectional quadrifilar antenna having circular polarization, a gain greater than about 3 dBi, a G/T greater than about −20 dB/K, and a frequency range of about 2.3 GHz to about 2.7 GHz, also known as the S-band. The antenna system can be used to receive satellite digital audio radio service (SDARS) and transfer the signal to a satellite radio receiver inside the vehicle.

25 Claims, 4 Drawing Sheets

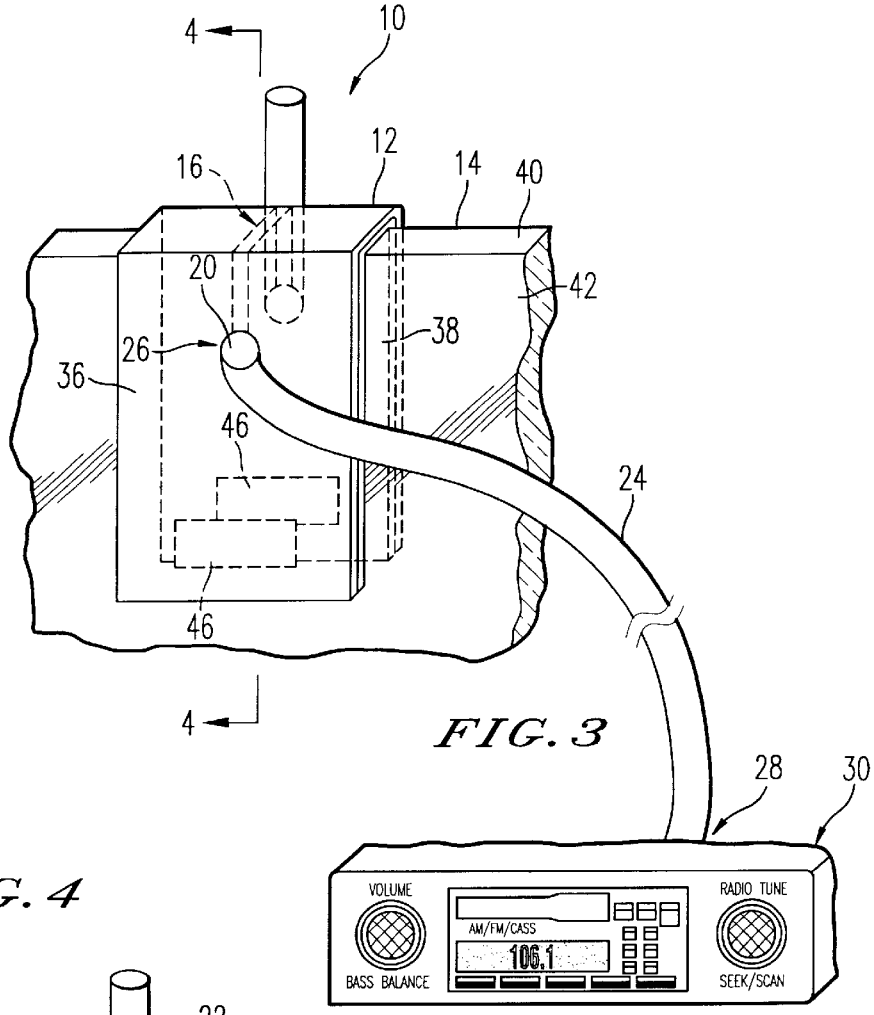
FIG. 3
FIG. 4
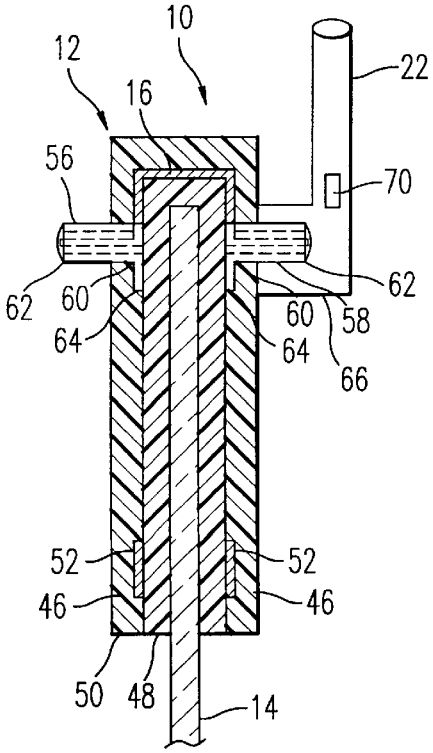

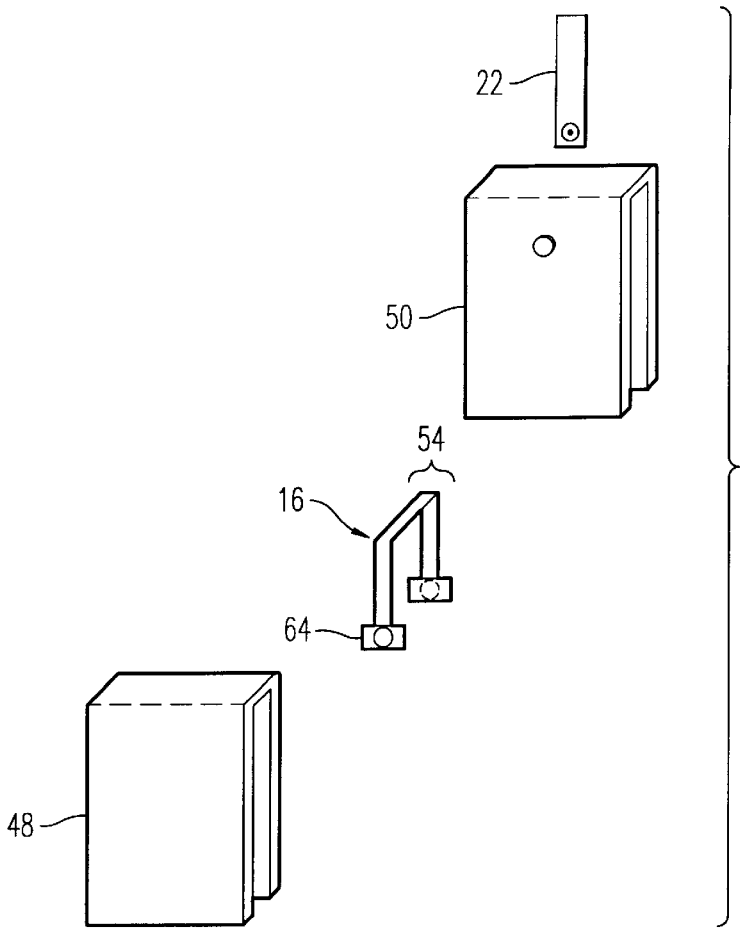
FIG. 5
FIG. 6
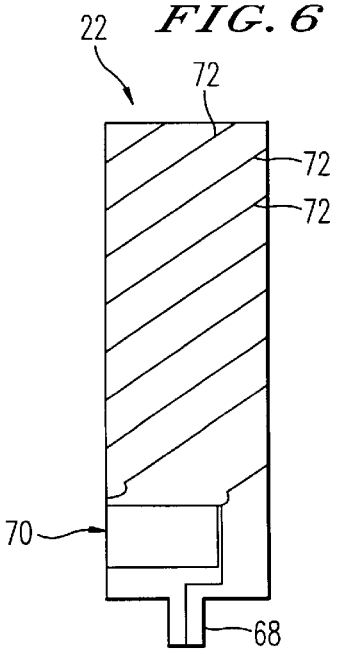
FIG. 7
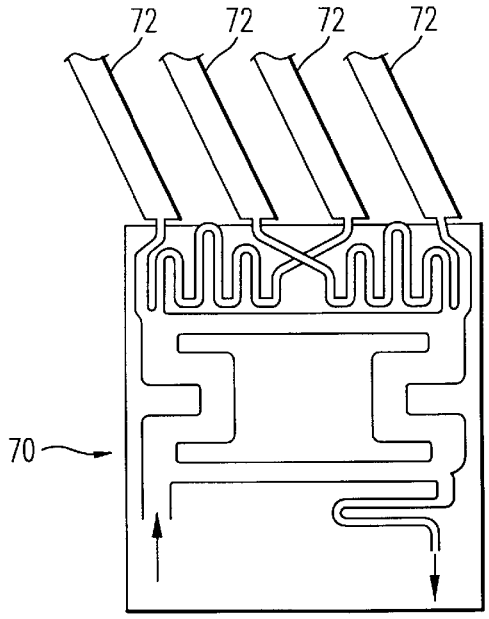

VEHICLE ANTENNA ASSEMBLY FOR RECEIVING SATELLITE BROADCAST SIGNALS

This application is a continuation of U.S. patent application Ser. No. 09/317,947, filed May 25, 1999 now U.S. Pat. No. 6,295,033.

FIELD OF THE INVENTION

The invention relates to an antenna apparatus, system and method for providing signals received from a satellite broadcast system to a radio receiver. More particularly, the invention relates to an antenna coupled to a transmission line integrated with a window clip mounted on a vehicle window, the interior portion of the transmission line being connectable to a radio receiver.

BACKGROUND OF THE INVENTION

A number of methods exist for transferring radio frequency (RF) signals through a window in an automobile. For example, an antenna can be attached to a window using an adhesive, and RF signals can be transferred to an apparatus on the inside of the window using capacitive coupling, slot coupling or aperture coupling. Typically, as is known in the art, the antenna system consists of a transmission line, a coupling device such as a capacitive plate, a slot, or an aperture, a matching circuit between the transmission line and the coupling device, and the antenna itself.

Known coupling methods require matching to the transmission line, that is, the RF signals transferred through the glass must be adapted to the particular transmission line, adding cost to the apparatus. Additionally, there is inherent signal loss due to coupling of approximately 1 dB or more, as well as an insertion loss due to the matching circuit.

Examples of prior vehicle antennas are disclosed in the U.S. Pat. No. 5,898,408 to Du, U.S. Pat. No. 4,882,592 to Studer, Jr. et al., U.S. Pat. No. 5,099,251 to Fisher, U.S. Pat. No. 4,799,098 to Blaese, U.S. Pat. No. 4,266,227 to Blaese, U.S. Pat. No. 4,109,251 to MacDougall, U.S. Pat. No. 5,850,199 to Wan et al., and U.S. Pat. No. 5,898,407 to Paulus et al.

Thus, there is a continuing need to provide an improved antenna system that reduces or eliminates signal loss caused by coupling.

SUMMARY OF THE INVENTION

In accordance with the present invention, an antenna system is provided for the reception of radio signals and transmission of the radio signals to a radio receiver where the radio signal is transmitted over a transmission line carried by a clip where an outside end of the transmission line is electrically connectable to an externally mounted antenna and an interior end of the transmission line is connectable to a radio receiver.

In accordance with one aspect of the present invention, a U-shaped clip is provided that is removably attached to an edge surface. The clip has an open end and a closed end, the open end being configured to receive the edge surface. The clip comprises a first member, a second member and a third member, the first member and the third member being disposed on opposite sides of the edge surface. The closed end is configured from the second member extending between the first member and the third member. A transmission line adapted to transport signals from the antenna is carried by the clip. The transmission line extends between the first member and the third member along the second member, wherein at least one of the first member, the second member and the third member are planar and comprise a first layer and a second layer between which the transmission line is disposed so as to enclose at least a portion of the transmission line between the first layer and the second layer. The first layer separates the transmission line from the edge surface. The second layer prevents exposure of the portion of the transmission line.

In accordance with another aspect of the invention, a clip is adapted for removably attaching to an edge surface of a vehicle. The clip is a U-shaped member comprising a first member, a second member and a third member. The first member and the third member are disposed substantially opposite each other on the interior and exterior, respectively, of the vehicle when the clip is attached to the edge surface. The second member extends between the first member and the third member and is disposed between the edge surface and at least one of the frame and the roof of the vehicle. A transmission line is adapted to transport signals from the antenna and be carried by the clip. The transmission line extends between the first member and the third member along the second member. At least the second member of the clip is planar and comprises a first layer and a second layer. The transmission line is disposed between the first layer and the second layer. The first layer separates the transmission line from the edge surface. The second layer separates the transmission line from the at least one of the frame and the roof of the vehicle.

BRIEF DESCRIPTION OF THE DRAWINGS

Referring now to the drawings, which form apart of the original disclosure:

FIG. 3 is a perspective view from the inside of the automobile of the clip shown in FIG. 2;

FIG. 4 is a cross-section of the antenna assembly taken along line 4—4 of FIG. 2;

FIG. 5 is an exploded view of the antenna assembly;

FIG. 6 is a plan view of the antenna with helical elements;

FIG. 7 is a close-up plan view of the phase-shift network; and

Throughout the drawing figures, like reference numerals will be understood to refer to like parts and components.

DETAILED DESCRIPTION OF THE PREFERRED EMBODIMENT

Figure 1:
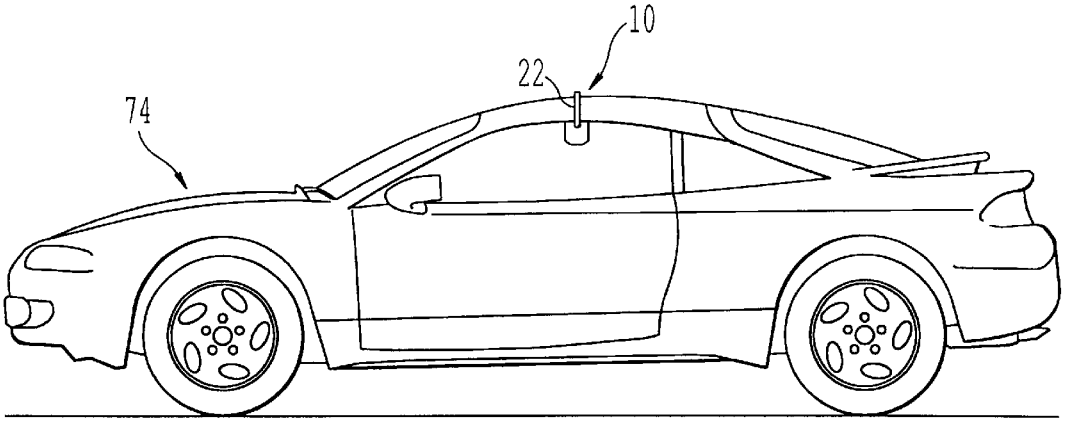
FIG. 1 depicts an antenna attached to a side window of an automobile in accordance with one embodiment of the present invention.
Figure 2:
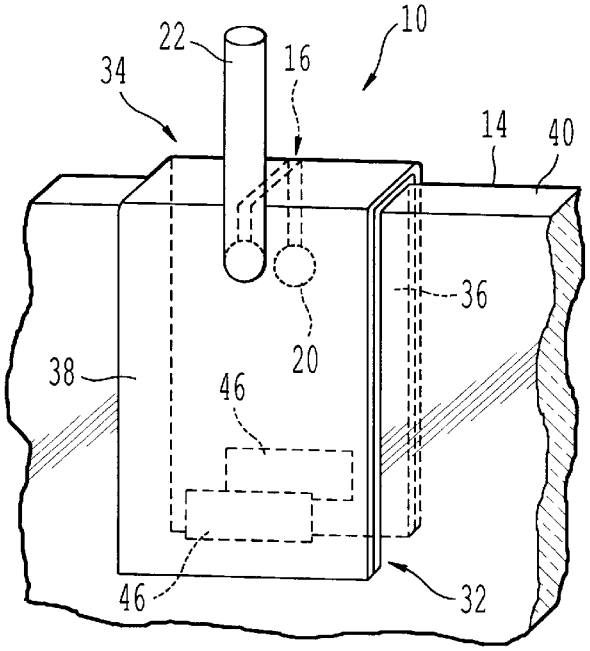
FIG. 2 is a perspective view from the outside of the automobile of the antenna shown in FIG. 1 attached to a clip which is mounted on the window edge.

As seen in FIGS. 1–7, the antenna assembly 10 in accordance with the invention comprises a holder or clip 12 mounted on a vehicle window 14, a transmission line 16 received in the clip 12, an outside connector 18 and an inside connector 20 received in the clip 12, the outside and inside connectors 18, 20 being electrically connected to the transmission line 16, and an antenna 22 electrically connected to the outside connector 18. An inside transmission line cable 24 is connected at a first inside transmission line cable end 26 to the inside connector 20 and at a second inside transmission line cable end 28 to a radio receiver 30.

The clip 12 is substantially U-shaped having an open end 32 and a closed end 34. The open end 32 of the clip 12 has an inside portion 36 and an outside portion 38. The edge 40 of the window 14 is received by the open end 32 of the clip 12, resulting in the outside portion 38 being in contact with the exterior surface 42 of the window 14 and the inside portion 36 being in contact with the inside surface 44 of the window 14. The clip 12 is held in place on the window 14 by resilient pressure between the inside portion 36 and the outside portion 38, but may also be held in place using magnetic force, suction, adhesive, glue, or clamping the inside and outside portions 36, 38 to the window 14. In the preferred embodiment, magnets 46 are placed in antipolar relationship in each of the inside and outside portions 36, 38 such that magnetic attraction assists in forcing the inside and outside portions 36, 38 to grip the inside and outside surfaces 42, 44 of the window 14 as the magnets are attracted to each other. The magnets 46 can be any magnetized material known in the art having sufficient size and strength to maintain an attractive force through the window 14.

The clip 12 can be fabricated from plastic, or any other material that can maintain a rigid or semi-rigid U-shape while having adequate flexible properties to ensure that the open end 32 of the clip 12 can pass over the window edge 40 and maintain an adequate holding force without the use of special tools. For example, the clip 12 can be fabricated from plastic or metal coated with a cushioning material to prevent damage to the window 14 or window edge 40, and can be fabricated in layers 48, 50 of the same or compatible materials. When the clip 12 is fabricated from layers 48, 50, pockets 52 are formed to contain magnets 46. The transmission line 16 is preferably placed between the layers 48, 50 to protect the transmission line 16 from destructive environmental forces, for example, crimping, cutting, abrasion, corrosion, and the like.

The transmission line 16 is fabricated from two planar lines 54 as shown in FIGS. 2–5. The transmission line 16 can be prefabricated 50 ohm metal line known in the art that is covered by an insulative material, not shown. In the preferred embodiment, each line 54 is approximately 2 mm wide and separated by approximately 0.2 mm. The transmission line 16 can also be a microstrip line or a strip line known in the art. The transmission line 16 can be attached to the clip 12 using means known in the art, for example, glue, adhesive, tape, coated twisted wire, clips, clamps, staples, and the like.

Inside and outside connectors 56, 58 each have a transmission line connector end 60 and a coaxial connector end 62. The transmission line connector end 60 is attached to a flange 64 which allows for both electrical connection to the transmission line 16 and for retention of the connectors within the clip 12. The inside end of the transmission line 16 is electrically connected to the inside transmission line connector end 60 of the inside connector 56, and the outside end of the transmission line 16 is electrically connected to the outside transmission line connector end 60 of the outside connector 58. The flange portions 64 of the connectors 56, 58 give each connector a point of attachment to the clip 12. When the clip 12 is multilayer, the flange portion 64 is positioned between the layers 48, 50, shown in FIG. 5. The coaxial connector end 62 of the connectors 56, 58 protrude through the outer layer 50 of the clip 12, allowing a user to connect the inside transmission line cable 24 to the coaxial connector portion 60 of the inside connector 56 and the antenna 22 to the outside coaxial connector portion 60 of the outside connector 58. Alternatively, the inside connector 56 can be eliminated and the inside transmission line cable 24 can be hard-wired directly to the inside end of the transmission line 16, for example, by soldering.

The antenna 22 is any radio antenna known in the art, approximately six inches or longer and a diameter of about one-fourth inch to about one-half inch, for receiving radio broadcast transmissions from a satellite. The antenna 22 can be, for example, a short stub antenna encased in plastic, for example, LEXAN, or a longer whip antenna, tuned to receive radio signals from about 2.3 GHz to about 2.7 GHz, also known as the S-band. The antenna 22 can be used to receive satellite digital audio radio service (SDARS), a satellite broadcast service recently established by the Federal Communications Commission (FCC), in a vehicle, operating in the 2.3 GHz to 2.4 GHz range.

The antenna 22 may be a quadrifilar antenna, for example, the type used for the Global Positioning Satellite System (GPS) and known in the art. The antenna 22 may be circularly polarized, preferably left-hand circularly polarized. Alternatively, the antenna 22 can be a dipole antenna, also known in the art. When the antenna 22 is a dipole antenna, it is preferable that the antenna 22 be vertically polarized.

The antenna 22 is preferably omnidirectional in an elevation plane between approximately 20 degrees to 60 degrees from the horizontal. The gain, G, of the antenna 22 is preferably greater than 3 dBi, and the gain to equivalent noise temperature ratio, G/T, is preferably greater than approximately −20 dB/K. The voltage standing wave ratio, VSWR, preferably has a value of about 2 or less, more preferably about 1.5 or less, where 1 is a perfect 50 ohm antenna.

At one end of the antenna 22 is an antenna mounting connector 66. The antenna mounting connector 66 attaches the antenna 22 to the clip 12, using, for example, a snap fit, a screw-on attachment, or any other attachment means known in the art. Attaching and removing the antenna 22 to the clip 12 preferably does not require special tools. However, a screwdriver or pliers can be utilized by the user depending on the attachment means to expedite the attachment or removal process. The amount of holding power of the antenna mounting connector 66 to the clip 12 should be sufficient to maintain the attachment of the antenna 22 to the clip 12 during normal driving conditions, for example, on a vehicle traveling at up to about 75 mph with wind gusts of up to about 40 mph.

The antenna mounting connector 66 also houses an antenna electrical connector 68 for electrically connecting the antenna 22 with the outside transmission line connector 58. The antenna electrical connector 68 can be any electrical connector known in the art, for example, coaxial or any other 50 ohm transmission line connector. The antenna mounting connector 66 and the antenna electrical connector 68 are preferably adapted to allow a user to connect and reconnect the antenna 22 from the clip 12 without using special tools.

When the antenna is a quadrifilar antenna, a phase-shift network 70 is mounted on the antenna 22. FIG. 6 shows four helical elements 72 of the phase-shift network 70 wrapped around the antenna 22. The phase-shift network 70 is necessary for the reception of the circularly polarized satellite signal and subsequent transmission of the signal to the transmission line 16, as known in the art.

When fully assembled, the antenna 22 is mounted to the clip 12. The antenna 22 is also electrically connected to the outside end of the transmission line 16. The inside end of the transmission line 16 is connected to the first inside transmission line cable end 28, allowing transfer of RE signals from the antenna 22 mounted outside the vehicle 74 to the inside of the vehicle 74. The second inside transmission line cable end 28 is connected to a radio receiver 30, transferring the RE signals to the radio receiver 30 for conversion to audio. The radio receiver 30 can be an SDARS receiver when the RF signals received by the antenna 22 are from a digital satellite audio broadcast.

Figure 8:
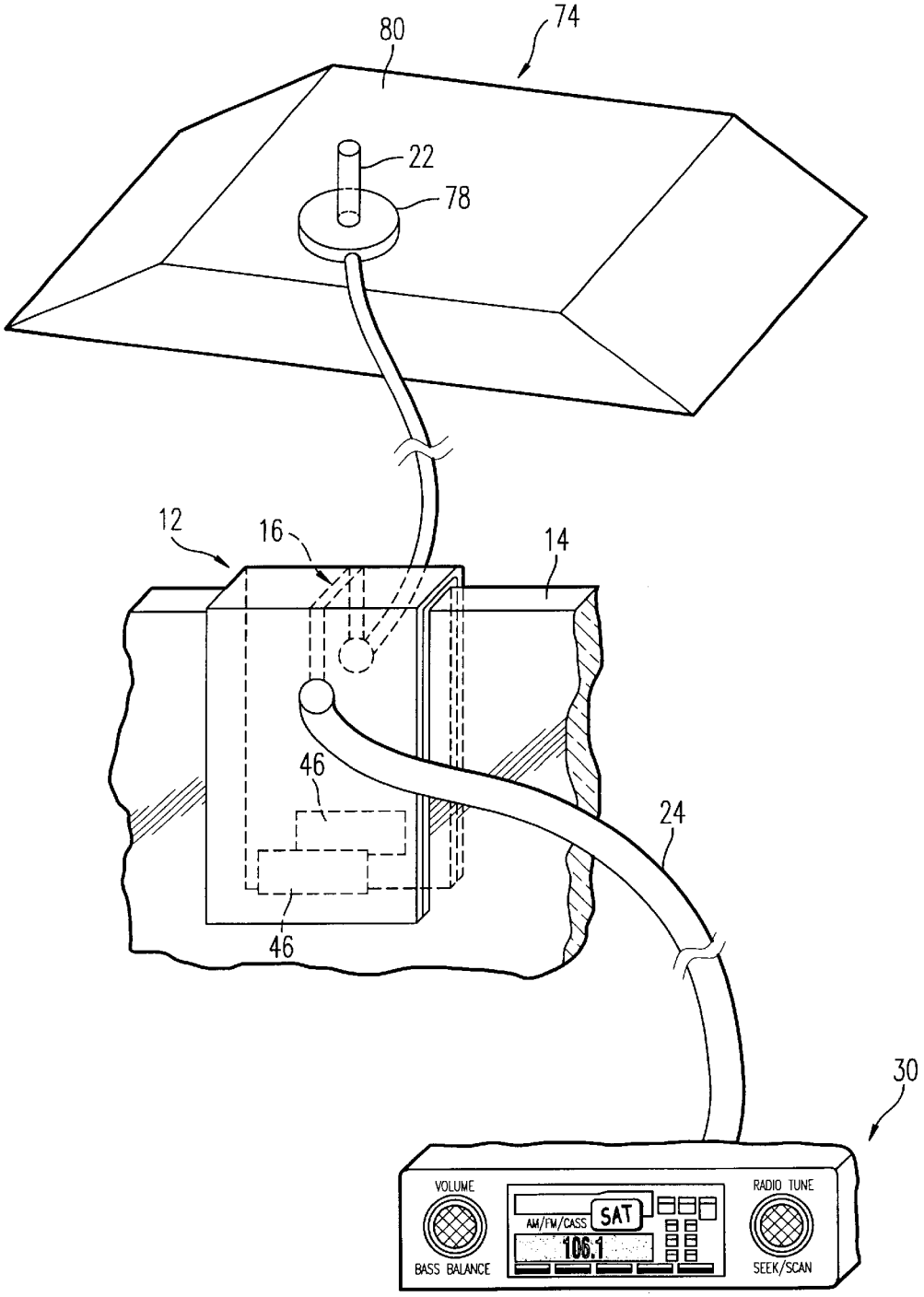
FIG. 8 shows another embodiment of the present invention where the antenna is attachable to the automobile roof and is connected to the clip by means of a cable.

In a second embodiment, shown in FIG. 8, the antenna 22 is not physically attached to the clip 12. Instead, the antenna 22 is electrically connected to the transmission line connector 58 protruding from the clip 12. The antenna 22 can be any antenna described above, and is attached to a portion of the vehicle 74, for example, the roof, trunk, fender, or windshield. The antenna 22 is mounted to the vehicle 74 using any means known in the art, for example, an adhesive, magnetic attraction, a screw-on connection, and the like. An exterior transmission cable 76, such as a coaxial cable, connects the antenna 22 to the outside end of the transmission line 16 on the clip 12. In the embodiment shown in FIG. 8, the antenna 22 is attached to a mounting unit 78. Mounting unit 78 has a magnet of sufficient strength to hold the mounting unit 78 and the antenna 22 to a metallic surface 80 on the vehicle, and to remain attached to the vehicle while moving at a speeds up to about 75 mph and wind gusts up to about 40 mph. The RF signals are then transferred to the interior of the vehicle 74 and the radio receiver 30 in the same manner described above. Thus, the antenna 22 is attached to the vehicle 74 at a location most advantageous to the reception of RF signals, for example, the roof or other high position on a vehicle, which is particularly advantageous when the RF signals emanate from a satellite. With the antenna at a relatively high location, signal blockage such as multipath from environmental obstructions, for example buildings and trees, can be reduced.

While advantageous embodiments have been chosen to illustrate the invention, it will be understood by those skilled in the art that various changes and modifications can be made therein without departing from the scope of the invention as defined in the appended claims.

What is claimed is:

1. An antenna assembly comprising:

a U-shaped clip removably attached to an edge surface, said clip having an open end and a closed end, said open end being configured to receive said edge surface, said clip comprising a first member, a second member and a third member, said first member and said third member being disposed on opposite sides of said edge surface, said closed end being configured from said second member extending between said first member and said third member; and a transmission line adapted to transport signals from said antenna and be carried by said clip, said transmission line extending between said first member and said third member along said second member, at least one of said first member, said second member and said third member being planar and comprising a first layer and a second layer between which said transmission line is disposed so as to enclose at least a portion of said transmission line between said first layer and said second layer, said first layer separating said transmission line from said edge surface, said second layer preventing exposure of said portion of said transmission line.

2. An antenna assembly as claimed in claim 1, wherein said clip further comprises an inside connector attached to said first member, said inside connector having a proximal end with respect to said clip that is coupled to one end of said transmission line and a distal end configured to electrically connect said transmission line to an electrical conductor extending from said clip.

3. An antenna assembly as claimed in claim 2, wherein said electrical conductor is a coaxial cable, and said distal end of said inside connector is electrically connected to said coaxial cable.

4. An antenna assembly as claimed in claim 2, wherein at least said first member is planar and comprises said first layer and said second layer, said proximal end of said inside connector being mounted on a flange member disposed between said first layer and said second layer.

5. An antenna assembly as claimed in claim 1, wherein said first member is configured to electrically connect one end of said transmission line to an electrical cable extending from said clip.

6. An antenna assembly as claimed in claim 1, wherein said clip further comprises an outside connector attached to said third member, said outside connector having a proximal end with respect to said clip that is coupled to one end of said transmission line and a distal end configured to electrically connect said transmission line to an antenna.

7. An antenna assembly as claimed in claim 6, wherein at least said third member is planar and comprises said first layer and said second layer, said proximal end of said outside connector being mounted on a flange member disposed between said first layer and said second layer.

8. An antenna assembly as claimed in claim 1, wherein said transmission line is configured as at least one flat and thin conductor to facilitate its disposal between said first layer and said second layer.

9. An antenna assembly as claimed in claim 1, wherein said third member of said clip is coupled to an antenna and said first member of said clip is coupled to an electrical cable extending therefrom, said transmission line being configured to conduct signals received via said antenna to said electrical cable.

10. An antenna assembly as claimed in claim 9, wherein said antenna is a quadrifilar antenna.

11. An antenna assembly as claimed in claim 10, wherein said antenna comprises a phase-shift network of plural helical elements.

12. An antenna assembly for mounting an antenna to a vehicle, the antenna assembly comprising:

a clip adapted for removably attaching to an edge surface of said vehicle, said clip being a U-shaped member comprising a first member, a second member and a third member, said first member and said third member being disposed substantially opposite each other on the interior and exterior, respectively, of said vehicle when said clip is attached to said edge surface, said second member extending between said first member and said third member and being disposed between said edge surface and at least one of the frame and the roof of said vehicle; and a transmission line adapted to transport signals from said antenna and be carried by said clip, said transmission line extending between said first member and said third member along said second member, at least said second member of said clip being planar and comprising a first layer and a second layer, said transmission line being disposed between said first layer and said second layer, said first layer separating said transmission line from said edge surface, said second layer separating said transmission line from said at least one of the frame and the roof of said vehicle.

13. An antenna assembly as claimed in claim 12, wherein said clip further comprises an inside connector attached to said first member for connecting to one end of said transmission line disposed inside said vehicle, said inside connector having a proximal end with respect to said clip that is coupled to one end of said transmission line and a distal end configured to electrically connect said transmission line to an electrical conductor extending from said clip.

14. An antenna assembly as claimed in claim 13, wherein said electrical conductor is a coaxial cable, and said distal end of said inside connector is electrically connected to said coaxial cable.

15. An antenna assembly as claimed in claim 13, wherein at least said first member is planar and comprises said first layer and said second layer, said proximal end of said inside connector being mounted on a flange member disposed between said first layer and said second layer.

16. An antenna assembly as claimed in claim 12, wherein said first member is configured to electrically connect one end of said transmission line to an electrical cable extending from said clip.

17. An antenna assembly as claimed in claim 12, wherein said clip further comprises an outside connector attached to said third member and adapted for connecting to one end of said transmission line disposed outside said vehicle, said outside connector having a proximal end with respect to said clip that is coupled to one end of said transmission line and a distal end configured to electrically connect said transmission line to an antenna.

18. An antenna assembly as claimed in claim 17, wherein at least said third member is planar and comprises said first layer and said second layer, said proximal end of said outside connector being mounted on a flange member disposed between said first layer and said second layer.

19. An antenna assembly as claimed in claim 12, wherein said transmission line is configured as at least one flat and thin conductor to facilitate its disposal between said first layer and said second layer.

20. An antenna assembly as claimed in claim 12, wherein said third member of said clip is coupled to an antenna and said first member of said clip is coupled to an electrical cable extending therefrom, said transmission line being configured to conduct signals received via said antenna to said electrical cable.

21. An antenna assembly as claimed in claim 12, wherein said third member of said clip is coupled to an antenna and said antenna is a quadrifilar antenna.

22. An antenna assembly as claimed in claim 21, wherein said antenna comprises a phase-shift network of plural helical elements.

23. An antenna assembly as claimed in claim 12, wherein said third member of said clip is coupled to an antenna, said antenna being disposed on an elevated surface of said vehicle and extending substantially vertically therefrom to facilitate satellite reception.

24. An antenna assembly as claimed in claim 12, wherein said third member of said clip is coupled to an antenna, said antenna being adapted to receive radio frequency signals is a frequency range of approximately 2,300 to 2,700 megahertz.

25. An antenna assembly as claimed in claim 12, further comprising an antenna that is removably attached to said third member of said clip.

* * * * *